United States Patent [19]

Sakaguchi et al.

[11] Patent Number: 4,987,949

[45] Date of Patent: Jan. 29, 1991

[54] PROTECTIVE COVER FOR SURFACE OF MOLTEN STEEL USED IN CONTINUOUS CASTING APPARATUS

[75] Inventors: Haruo Sakaguchi, Osaka; Shiromitsu Iwatani, Nara; Toshikatsu Okao, Osaka, all of Japan

[73] Assignee: Hitachi Zosen Corporation, Japan

[21] Appl. No.: 381,517

[22] Filed: Jul. 18, 1989

[30] Foreign Application Priority Data

Jul. 29, 1988 [JP] Japan ..... 63-191895
Feb. 21, 1989 [JP] Japan ..... 1-41439

[51] Int. Cl.[5] ..... B22D 11/06; B22D 11/10
[52] U.S. Cl. ..... 164/450; 164/428
[58] Field of Search ..... 164/428, 480, 123, 450; 249/204, 197, DIG. 5

[56] References Cited

U.S. PATENT DOCUMENTS 4,050,668 9/1977 Perri ..... 249/204

FOREIGN PATENT DOCUMENTS 138059 4/1985 European Pat. Off. ..... 164/480
958767 2/1957 Fed. Rep. of Germany ..... 249/204
58-224048 12/1983 Japan ..... 164/480
62-77152 4/1987 Japan ..... 164/480
62-34456 7/1987 Japan ..... 164/428

*Primary Examiner*—Kuang Y. Lin
*Attorney, Agent, or Firm*—Barnes, Kisselle, Raisch, Choate, Whittemore & Hulbert

[57] ABSTRACT

The present invention provides a protective cover for a surface of molten steel used in a continuous casting apparatus provided with a pair of movable mold walls arranged in parallel to each other and a melt receiver formed between said movable mold walls, for example a twin-roll type casting apparatus, said protective cover comprising a central heat insulator capable of bringing into contact with a central portion of a surface of the molten steel other than portions close to portions where the surface of the molten steel is brought into contact with the respective movable mold walls and side heat insulators mounted on said central heat insulator, covering spaces above said portions close to the portions where the surface of the molten steel is brought into contact with the respective movable mold walls and being brought into slidable contact with the surfaces of the respective movable mold walls at pointed end portions thereof. The protective cover having such the construction can prevent the oxidation and temperature reduction of the surface of the molten steel, so that no foreign substance is mixed in the molten steel thereby a thin plate showing no defect can be produced.

4 Claims, 4 Drawing Sheets

PROTECTIVE COVER FOR SURFACE OF MOLTEN STEEL USED IN CONTINUOUS CASTING APPARATUS

FIELD OF THE INVENTION

The present invention relates to a protective cover for a surface of molten steel used in a continuous casting apparatus having movable mold walls, for example a twin-roll type continuous casting apparatus.

BACKGROUND OF THE INVENTION

A twin-roll type continuous casting apparatus has been known as an apparatus for continuously casting a thin metallic plate. This twin-roll type continuous casting apparatus is, as described later with reference to the drawings, provided with a pair of mold rolls (hereinafter referred to as rolls), weir members for forming a melt receiver between said rolls and a tundish provided with a molten metal-pouring nozzle for pouring the molten steel into the melt receiver. The molten steel accumulated in the melt receiver is joined and pressed to be turned into a piece of slab by rotating the rolls and then the thin plate is produced by drawing out the slab.

However, when a surface of the molten steel poured into the melt receiver is oxidized or cooled, oxides, a shell formed on the surface thereof when cooled, dissolved substances from refractories of the tundish and the nozzle raised to the surface of the molten steel and the like are swallowed up by a flow of the molten steel. This causes internal defects or surface defects of the thin plate. Accordingly, the upper part of the surface of molten steel has been covered with a cover and inert gases have been poured into the cover to prevent the oxidation. Also a measure, in which a surface of molten steel is covered with heat-insulating powders to not only cut off air and prevent a temperature reduction but also adsorb the dissolved refractory substances thereby reducing a quantity of the dissolved refractory substances swallowed up by the flow of the molten metal, has been thought.

However, the above described conventional measure using inert gases has shown a problem in that a space within the cover has not only a large volume but also a large surface area, so that a radiant heat capacity is large thereby the surface of the molten steel is cooled to form the shell on the surface of the molten steel. In addition, in the case where the powders are used, if the powders are swallowed up by the flow of the molten steel to not only make the slab not uniform in thickness but also be turned into floating materials which are mixed in the molten steel, the internal defects are brought about, so that the defects are brought about in the products similarly.

DISCLOSURE OF THE INVENTION

It is an object of the present invention to provide a protective cover for a surface of molten steel used in a continuous casting apparatus having movable mold walls, which is capable of solving the above described problems.

In order to achieve this object a protective cover according to the present invention is a protective cover for a surface of molten steel used in a continuous casting apparatus provided with a pair of movable mold walls arranged in parallel to each other and a melt receiver formed between said movable mold walls for accumulating the molten steel therein said protective cover comprising a central heat insulator capable of being brought into contact with a central portion of the surface of the molten steel other than portions close to portions where the surface of the molten steel is brought into contact with the respective movable mold walls and side heat insulators mounted on said central heat insulator, covering spaces above said portions close to the portions where the surface of the molten steel is brought into contact with the respective movable mold walls and being brought into slidable contact with the surfaces of the respective movable mold walls at pointed end portions thereof.

According to the above described construction, the surface of the central portion, which is the greater part of the surface of the molten steel accumulated in the melt receiver, is cut off from air by means of the central heat insulator brought into direct contact therewith and the temperature reduction of the molten steel is prevented. In addition, spaces above the portions where the surface of the molten steel is brought into contact with the movable mold walls, are reduced in volume and cut off from the outside by means of the side insulators so that the temperature reduction and oxidation of the molten steel can be prevented as far as possible.

On the other hand, according to another construction of the present invention, a protective cover according to the present invention is a protective cover for a surface of molten steel used in a continuous casting apparatus provided with a pair of movable mold walls arranged in parallel to each other and a melt receiver formed between said movable mold walls for accumulating the molten steel therein, said protective cover comprising a heat insulator capable of floating on the surface of the molten steel and covering almost all over the surface of the molten steel and immersion walls projected downwards from said heat insulator and arranged almost in parallel to and at appointed intervals from surfaces of the movable mold walls.

According to the above described construction, almost all of the surface of the molten steel accumulated in the melt receiver is cut off from air by means of the heat insulator brought into direct contact therewith and the temperature reduction of the molten steel is prevented. In addition, since the immersion walls are provided on both sides of the heat insulator, the fresh molten steel is flown into a space between the movable mold walls and the immersion walls thereby the surface layer portion of the slab shell on the movable mold walls is molten again to eliminate the fluctuation in thickness.

DESCRIPTION OF THE PREFERRED EMBODIMENTS

Figure 1:
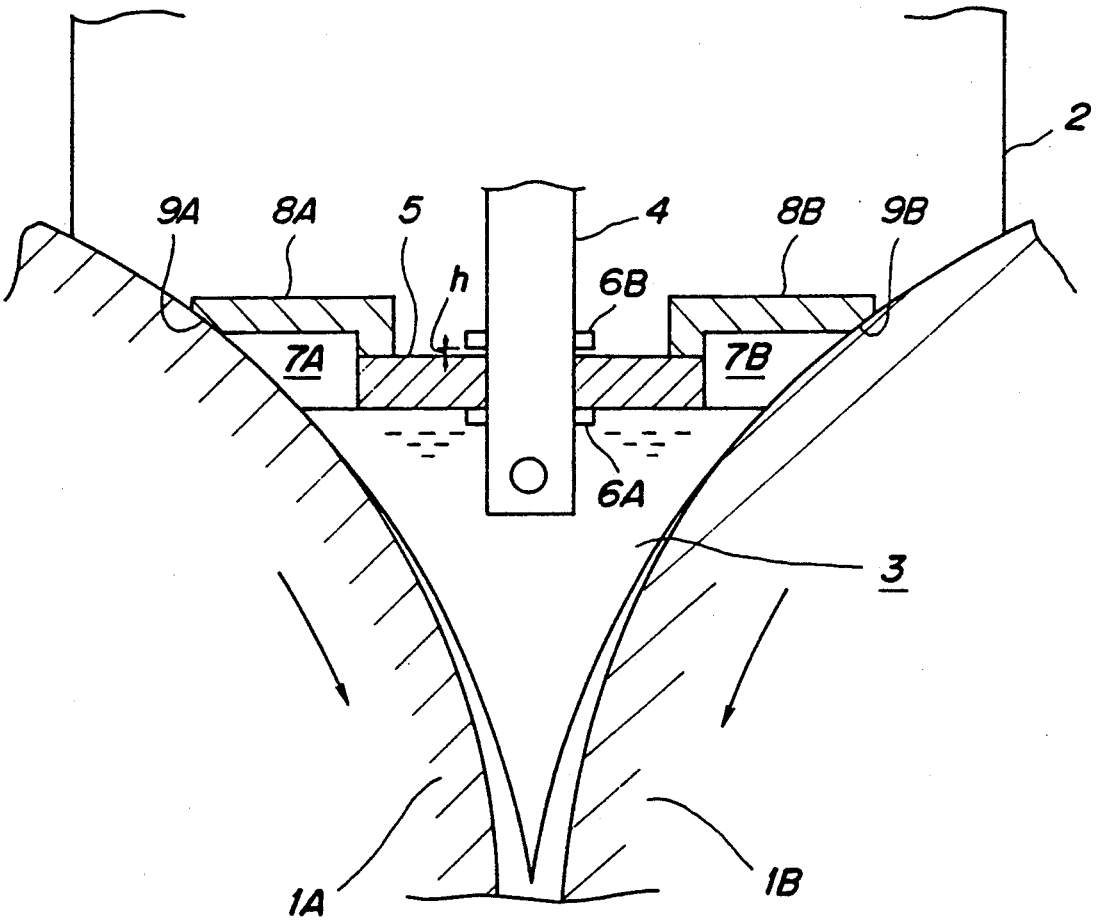
FIG. 1 is a sectional view showing a protective cover for a surface of molten steel according to one preferred embodiment of the present invention.

At first, the conventional example is described with reference to the drawing prior to the description of the preferred embodiments of the present invention.

Figure 4:
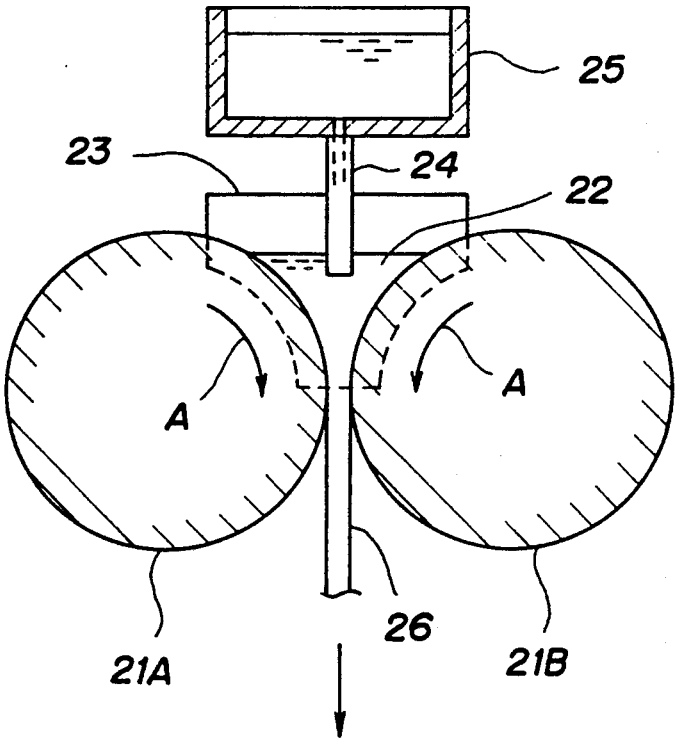
FIG. 4 PRIOR ART
FIG. 4 is a general sectional view showing the conventional example.

A twin-roll type continuous casting apparatus has been known as an apparatus for continuously casting a thin metallic plate. This twin-roll type continuous casting apparatus is, as shown in FIG. 4, provided with a pair of mold rolls 21A, 21B arranged in parallel to each other weir members 23 arranged so as to be brought into contact with end faces of said rolls 21A , 21B for forming a melt receiver 22 between both rolls 21A, 21B (merely one is shown) and a tundish 25 provided with a molten metal pouring nozzle 24 for pouring a molten steel into said melt receiver 22. In the case where the thin plate is continuously casted by the use of this construction, if both rolls 21A, 21B are rotated in the direction of an arrow A under the condition that the molten steel is accumulated in the melt receiver 22, slab shells, which have been formed on the surface of the respective rolls 21A, 21B, are joined and pressed at the central portions of both rolls 21A, 21B to be turned into a piece of slab followed by being continuously drawn out as the thin plate 26.

The thin plate produced in the above described manner shows, as above described, a disadvantage in that foreign substances are contained in an inside or an outer surface thereof.

One preferred embodiment of the present invention is below described with reference to FIG. 1.

Reference numerals 1A, 1B designate mold rolls (hereinafter called rolls for short), which are one kind of movable mold walls, arranged in parallel to each other. A melt receiver 3 is formed between said both rolls 1A, 1B by the cooperation of both rolls 1A, 1B with a pair of weir members (called also short side weirs and merely one is shown) 2 arranged so as to be brought into contact with both end faces of both rolls 1A, 1B. Reference numeral 4 designates a molten metal-pouring nozzle for introducing a molten steel into the melt receiver 3 from a tundish (not shown). Said molten metal pouring nozzle 4 is hung down from the tundish. A rectangular central heat insulator 5, which is brought into contact with a central portion of a surface of molten steel (hereinafter called a surface for short) other than portions close to portions where the surface is brought into contact with the rolls 1A, 1B, is supported by upper and lower stoppers 6A, 6B below said nozzle 4. In addition, this central heat insulator 5 is adapted to be movable by an appointed height (h) between the stoppers 6A, 6B. This aims at the follow after the fluctuation of the surface. And, in addition, side heat insulators 8A, 8B for covering spaces 7A, 7B formed above said portions close to the portions where the surface is brought into contact with the respective rolls 1A, 1B are projected upwards from side edge portions of the central heat insulator 5 parallel to the respective rolls 1A, 1B. In addition, lower surfaces 9A, 9B of pointed end portions of said side heat insulators 8A, 8B are adapted to be brought into slidable contact with circumferential surfaces of the respective rolls 1A, 1B. Accordingly, the central portion of the surface is directly covered with the central heat insulator 5 and the spaces 7A, 7B formed above both side portions on the sides of the respective rolls 1A, 1B of the surface are covered with the side heat insulators 8A, 8B. It goes without saying that end faces of the respective heat insulators 5, 8A, 8B on the side of the weir members 2 are brought into contact with surfaces of the weir members 2.

Next, the above mentioned respective heat insulators are described. The central heat insulator 5 is formed of ceramic fibers having a small specific gravity or foamed refractories so as to rise to the surface of molten steel. In addition, in the case where powdery refractories are used in place of ceramic fibers or foamed refractories, a fibrous layer formed of fibers having a length of 5 mm or more is provided on the surface of the powdery refractories so that the powders may not be flown into the molten steel. Air having the lower heat conductivity can be contained within the central heat insulator 5 and thus the insulation can be enhanced by using such the materials. Also a box member formed of titanium alloys resisting to a steel-melting temperature which contains ceramic wools or foamed refractories therein may be used as the central heat insulator 5. In addition, a high-temperature combustion gas may be passed through an inside of the central heat insulator 5 in addition to the above described construction to enhance the insulating effect. In addition, ceramics, metals and the like are used as materials of the side heat insulators 8A, 8B. In addition, the portions brought into slidable contact with the respective rolls 1A, 1B of the side heat insulators 8A, 8B may be formed of graphite materials having an excellent slidability.

Accordingly, the central surface, which is the greater part of the surface, is cut from air by means of the central heat insulator 5 brought into direct contact therewith and also the temperature reduction of the molten steel is prevented. In addition, the portions, where the surface is brought into contact with the respective rolls 1A, 1B, are restricted by means of the side heat insulators 8A, 8B to form the small spaces 7A, 7B and cut off from the outside, so that the radiation and oxidation are remarkably suppressed and the molten steel can be smoothly swallowed up.

Since the greater part of the surface is adapted to be covered by bringing into direct contact with the central heat insulator 5, the oxidation and temperature reduction of the surface can be prevented without using heat-insulating powders, so that foreign substances are not mixed in the molten steel and thus the slab, that is, the thin plate, drawn from between both rolls does not show defects. In addition, in order to prevent the oxidation, it is more preferable to feed the spaces 7A, 7B with inert gases.

Figure 2:
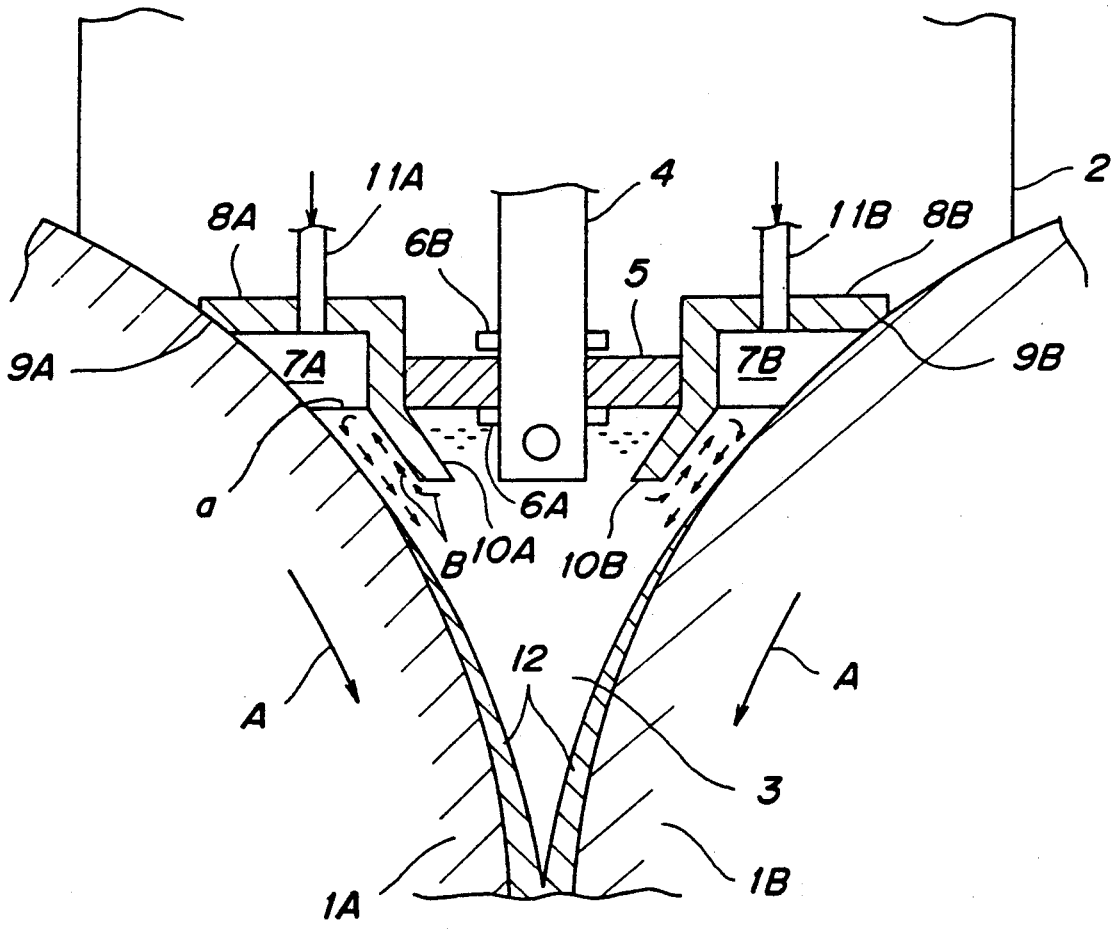
FIG. 2 is a sectional view showing a protective cover for a surface of molten steel according to another preferred embodiment of the present embodiment.

Next, another preferred embodiment of the present invention is described with reference to FIG. 2.

In this case, immersion walls 10A, 10B almost parallel to and at an appointed interval from the surfaces of the rolls 1A, 1B are projected downwards from edge portions on both sides of the central heat insulator 5 in the above described preferred embodiment parallel to the respective rolls 1A, 1B and inert gas feed pipes 11A, 11B are connected with the side heat insulators 8A, 8B.

The above described immersion walls 10A, 10B are formed of refractories which are difficult to be eroded by the molten steel. Concretely speaking, alumina-graphite and zirconia are used although they are selected depending upon the kind of steels. In addition, an immersion depth of the immersion walls 10A, 10B is selected within a range of for example about 10 to 100 mm and distances between the immersion walls 10A, 10B and the surfaces of the rolls 1A, 1B are selected within a range of about 10 to 40 mm in view of the stability of the casting.

Accordingly, when the rolls 1A, 1B are rotated in the direction of an arrow A, the molten steel in the vicinity of a slab shell 12 is similarly moved downwards with the downward movement of the slab shell 12 due to the viscosity thereof but the fresh molten steel is flown into the upper portion over the immersion walls 10A, 10B, as shown by the arrow B, to fill up the molten steel moved in the above described manner. Accordingly, not only a turbulent flow zone is brought about in a borderline between flows turning to the directions opposite to each other but also the surface of the slab shell 12 formed on the surfaces of the rolls 1A, 1B can be molten again by a heat capacity of the fresh molten steel. Accordingly, the slab shell 12 formed on the surfaces of the rolls 1A, 1B becomes uniform in thickness.

In the case having this construction, not only the oxidation and temperature reduction of the surface can be prevented in the same manner as in the above described preferred embodiment but also the spaces 7A, 7B formed above the portions where the surface is brought into contact with the rolls 1A, 1B are fed with inert gases, so that the oxidation of the molten steel on the surface can be surely prevented. In addition, the high temperature fresh molten steel from the nozzle 4 is flown upstream upwards in the vicinity of the surface due to the existence of the immersion walls 10A, 10B to maintain a temperature of a surface (a) of the swallowed-up portion at a temperature preventing the shell from being generated. Furthermore, the surface layer portion of the slab shell 12 (a surface where the coagulation is made progress, that is, an inner surface of the shell) formed on the surfaces of the rolls 1A, 1B is molten again, so that the slab shell 12 becomes uniform in thickness. Besides, the immersion walls 10A, 10B prevent the uneven thickness and damage of the slab shell 12 resulting from the direct collision of the molten steel spouted from the nozzle 4 with the slab shell 12 on the surfaces of the rolls 1A, 1B.

Figure 3:
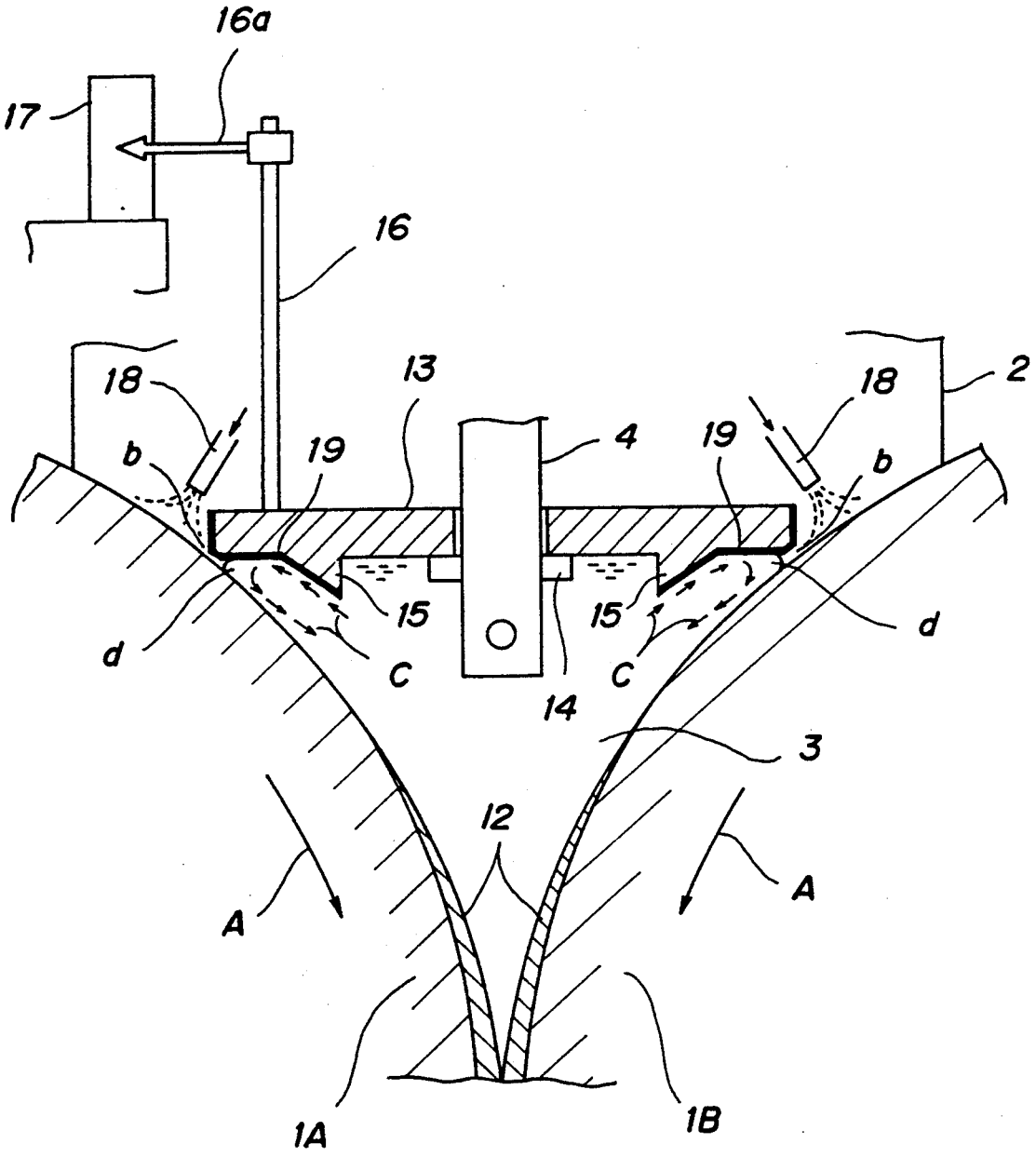
FIG. 3 is a sectional view showing a protective cover for a surface of molten steel according to a third preferred embodiment of the present invention.

Next, a third preferred embodiment of the present invention is described with reference to FIG. 3.

In this preferred embodiment mold rolls 1A, 1B, weir members 2, a melt receiver 3 and a nozzle 4 are similar to those in the preferred embodiment shown in FIG. 1 in construction.

A heat insulator 13 having a rectangular cross section is elevatably supported through a stopper 14 below the nozzle 4 so as to float in contact with all of the surface of molten steel, correctly the surface other than the vicinity of the portions where the surface is brought into contact with the respective rolls 1A, 1B. In addition, immersion walls 15 having an inverse triangular section are projected from lower surfaces of both side portions of the above described heat insulator 13 in parallel to axis shaft lines of the rolls 1A, 1B at an appointed interval from the surfaces of the rolls 1A, 1B. Furthermore, the stopper 14 is positioned so that both end portions of the heat insulator 13 may not be brought into slidable contact with the surfaces of the rolls 1A, 1B, that is, an appointed gap (b) may be secured between them. Above the stopper 14, the heat insulator 13 is adapted to freely follow the surface. And, the surface is controlled so that no gap may be produced between the surface and the heat insulator 13. That is to say, a surface detecting rod 16 is projected from an upper surface of the heat insulator 13 and on the fixed side of the continuous casting apparatus a position of a horizontal support portion 16*a* of the surface-detecting rod 16 is detected by means of a level detector 17 and the level-value is put in a surface controller not shown) so that a quantity of molten steel may be increased when the surface is low and the quantity of molten steel may be decreased when the surface is high thereby the surface may be maintained at an almost constant level. In addition, inert gas supply pipes 18 for spraying inert gases, such as $N_2$ gas and Ar gas, into the gap (b) are arranged so that air may be prevented from being swallowed up by the molten steel through the gap (b) between the rolls 1A, 1B and the heat insulator 13. Besides, the above described heat insulator 13 is formed of substances capable of floating on the surface, for example a substance obtained by pressing alumina fibers. Furthermore the surface on the molten steel side of the heat insulator 13 from the immersion walls 15 to outer end faces is coated with ceramics (for example zirconia) 19 so that the useful life time may be increased. That is to say, unless the heat insulator 13 is coated, the heat insulator 13 is molten by heat to float within the molten steel followed by gradually being molten in the molten steel. The coating 19 prevents this.

With the above described construction, upon starting the casting, the whole surface is cut off from air and the temperature reduction of the molten steel is prevented by the heat insulator 13 brought into direct contact with the surface. And, in this time, the quantity of the molten steel to be poured is controlled by means of the level detector 17 so that the surface may be always maintained at the suitable level. Since the whole surface is covered by bringing it into direct contact with the heat insulator 13, the oxidation and temperature reduction of the surface can be prevented without using powders, so that no foreign substance is mixed in the molten steel thereby the slab, that is, the thin plate drawn from between both rolls shows no defect. In addition, the gap (b) between the heat insulator 13 and the rolls 1A, 1B is fed with inert gases from the inert gas supply pipes 18 to surely prevent the molten steel from being oxidized.

In addition, in the case where the rolls 1A, 1B are rotated in the direction shown by the arrow A, the molten steel in the vicinity of the slab shell 12 formed on the surfaces of the rolls 1A, 1B is similarly moved downwards with the downward movement of the slab shell 12 due to the viscosity thereof but the fresh molten steel is flown into the upper portion over the immersion walls 15, as shown by the arrow (c), to fill up the molten steel moved. Accordingly, not only the turbulent flow zone is brought about in the borderline between flows turning to the directions opposite to each other but also the surface of the slab shell 12 formed on the surfaces of the rolls 1A, 1B can be molten again by the heat capacity of the fresh molten steel thereby the slab shell 12 formed on the surfaces of the rolls 1A, 1B becomes uniform in thickness. In addition, the molten steel is stably swallowed up at a portion (d) by rectifying the stream of the molten steel in the direction of width to prevent the slab shell 12 being formed on the lower surfaces of the heat insulator 13 on the sides of the rolls iA, iB from the immersIon walls 15, so that the slab shell is not swallowed up. Furthermore, these immersion walls 15 prevent the uneven thickness or the damage of the slab shell 12 resulting from the direct collision of the molten steel spouted from the nozzle 4 with the slab shell 12 on the surfaces of the rolls 1A, 1B.

Hereupon, although the weirs 2 are adapted to be brought into slidable contact with the respective end faces of the rolls 1A, 1B in the above described respective preferred embodiments, for example the weirs 2 may be placed so as to be brought into slidable contact with the circumferential surfaces of the rolls 1A, 1B from above. In addition, although the central heat insulator 5 or the heat insulator 13 is supported and guided by means of the nozzle 4 in the above described respective preferred embodiments, it may be supported and guided by means of the weirs 2. Furthermore, although the twin-roll type continuous casting apparatus is used in the above described preferred embodiments, the present invention can be applied also to the belt type and caterpillar type continuous casting apparatus.

What is claimed is:

1. In a continuous casting apparatus having a pair of movable mold walls arranged in parallel relation to each other and a melt receiver formed between said movable mold walls for accumulating molten metal therein, the improvement of a protective cover for the surface of the molten metal comprising:

a central heat insulator supported between and in spaced relation to said movable mold walls and adapted to contact a central portion of the surface of the molten metal but not to contact the side portions of said surface of the molten metal adjacent to said mold walls, and side head insulators mounted on said central heat insulator and spaced above said central heat insulator and above said side portions of said surface of the molten metal, said side heat insulators slidably contacting with the surfaces of the respective movable mold walls above said surface of the molten metal.

2. A protective cover as set forth in claim 1, further comprising immersion walls projecting downwards from the central head insulator so as to extend into the molten metal and arranged almost parallel to and at predetermined distances from the surfaces of the respective movable mold walls.

3. In a continuous casting apparatus having a pair of movable mold walls arranged in parallel relation to each other and a melt receiver formed between said movable mold walls for accumulating molten metal therein, the improvement of a protective cover for the surface of the molten metal comprising:

a heat insulator supported between said mold walls and adapted to float on the surface of the molten metal and cover substantially all over the surface of the molten metal, and immersion walls projected downwards from said heat insulator so as to extend into the molten metal and arranged almost parallel to and at predetermined distances from surfaces of the respective movable mold walls.

4. A protective cover as set forth in claim 3, further comprising:

surface detecting means attached to the upper surface of the heat insulator and vertically movable with the heat insulator, means for detecting the level of the surface of the molten metal by detecting the vertical position of the surface detecting means, and means for controlling the level of the molten metal by increasing and/or decreasing the quantity of the accumulated molten metal according to the result of the detection of the level thereof.

* * * * *